United States Patent [19]

Grant

[11] 4,164,099

[45] Aug. 14, 1979

[54] CONTACT LENS TOOL

[76] Inventor: Alan H. Grant, 3208 Woodhollow Dr., Chevy Chase, Md. 20015

[21] Appl. No.: 876,985

[22] Filed: Feb. 10, 1978

[51] Int. Cl.[2] ..... B24B 41/06; B24B 47/00

[52] U.S. Cl. ..... 51/216 LP; 51/229; 51/235; 269/21; 279/3

[58] Field of Search ..... 51/216 LP, 217 L, 229, 51/235; 269/21; 279/3

[56] References Cited

U.S. PATENT DOCUMENTS

| | | | |
|---|---|---|---|
| 3,125,836 | 3/1964 | Printz | 51/229 |
| 3,134,208 | 5/1964 | Richmond | 51/235 |
| 3,274,737 | 9/1966 | Rocher | 51/235 |
| 3,647,380 | 3/1972 | Middleton | 51/235 |

*Primary Examiner*—Harold D. Whitehead

*Attorney, Agent, or Firm*—Berman, Aisenberg & Platt

[57] ABSTRACT

A contact lens holder or tool for grinding or polishing, including a handle, a tubular receptacle open at its outer end and having a shaft protruding from its inner end which is rotatably mounted in the handle, a deformable fluid chamber closely fitted into the receptacle and having an open outer end protruding therefrom, a plug having an axial passage leading from an arcuate, external, lens-holding surface to the interior of the fluid chamber, an opening in the tubular receptacle wall, and an insertable and removable mechanical evacuator having a portion inserted into said opening to deform the fluid chamber, so as to partially evacuate the chamber and hold a lens against the arcuate surface of the plug, and removed from the opening to permit non-eccentric spinning of the receptacle, fluid chamber, plug and lens with respect to the handle, while the lens is being ground or polished.

12 Claims, 5 Drawing Figures

CONTACT LENS TOOL

BACKGROUND OF THE INVENTION

1. Field of the Invention

The invention relates to a vacuum-assisted holding tool, and in particular to a device for holding a contact lens against a rotating cutting or polishing surface, and which permits spinning of the lens during the grinding or polishing operation.

2. Description of the Prior Art

Traditionally, hard contact lenses are modified to a desired contour in grinding, or polishing, by adhering the lens blank with double-sided adhesive tape to a spinning tool to be held against a rotating cutting or polishing surface, or lap. The application and removal of the double-sided adhesive are both time consuming, an frequently produce undesirable surface scratches in the lens.

Various attempts have been made to secure the lens by means of electrically induced suction, but these have been only marginally successful, inasmuch as, when adequate suction was achieved to securely hold the lens and to withstand stresses induced during grinding or polishing, frequently the lens would either break or warp during the process.

SUMMARY OF THE INVENTION

The invention proposes a device designed to overcome the above-mentioned prior art shortcomings, defects and disadvantages, while presenting novel objects, features and advantages of which the most important are:

a vacuum device operated by a separate mechanical evacuator which is inserted through an opening in a lens holder sleeve to establish suction for securely holding the lens, and which is removed during grinding or polishing so as to permit non-eccentric spinning of the lens holder;

a friction free mounting of the lens holder sleeve in a handle to readily permit true spinning of the lens during grinding or polishing;

a lens holder sleeve which fits glove-tightly around a deformable fluid chamber to permanently hold the chamber coaxially aligned for true spinning rotation, even when partially evacuated;

a heavy rubber suction cup or plug which does not suffer distortion under vacuum pressure, and which may be reversed in the mouth of the fluid chamber so as to hold either a concave or convex lens blank; and a plurality of mechanical evacuators having operating stems of different cros-sectional areas so as to permit selecting and varying the amount of vacuum in the deformable fluid chamber.

These objects, advantages and constructional features are combined in a preferred embodiment of the invention, which includes a handle, a tubular sleeve which is friction free mounted at one end for rotation in the handle, a deformable rubber fluid chamber closely mounted in the sleeve and protruding from its other end, a non-deformable plug closing the protruding mouth of the fluid chamber, but having an axial passage therethrough communicating the interior of the fluid chamber with the exterior of the plug, arcuate surfaces at the ends of the plug for seating lens blanks of different configuration, an opening in the wall of the sleeve, and one or more mechanical evacuators each having a portion insertable through the opening, to deform the fluid chamber and establish vacuum for holding a lens, and removable from the opening to permit non-eccentric rotation of the sleeve during grinding or polishing.

An added feature of the invention relates to provision of a plurality of channels in the arcuate surfaces of the plug, radiating from the axial passage, so as to increase the suction area and hold the lens more securely.

From the above, it will be apparent that the invention meets a primary object in the provision of a spinning tool device which securely holds a lens during grinding or polishing, without the use of double-sided adhesive strips and their disadvantages, and without creating eccentric rotation of the holder.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the specific embodiment when read in connection with the accompanying drawings, wherein like reference characters indicate like parts throughout the several figures and in which:

DESCRIPTION OF THE PREFERRED EMBODIMENT

Figure 1:
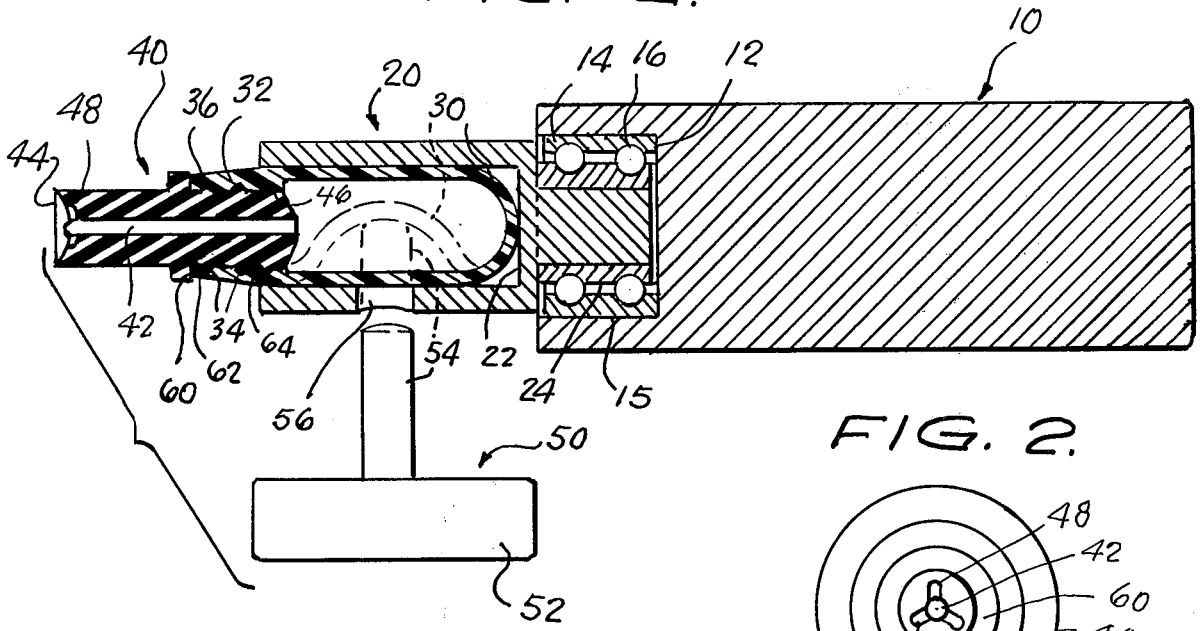
FIG. 1 is a longitudinal, cross-section of a contact lens holder or tool according to the invention, showing the separate mechanical evacuator in elevation and the partial evacuation of the fluid chamber in broken lines.

Referring now more particularly to the drawings, the preferred embodiment of the invention is shown as comprising a handle 10, a spinning receptacle or sleeve 20, a deformable chamber 30 housed in the receptacle an closed by a plug 40, in combination with a mechanical evacuator 50.

The handle 10 is preferably formed of wood or metal as a cylinder having an axial recess 12 at one end for receiving a stub axle portion 24 of holder sleeve 20. Inner and outer, annular races 14, 15 are friction fit tightly in the wall of recess 12 and seat ball bearings 16. The inner race 14 is fit tightly by friction on stub axle 24. The sleeve 20 is tubular and closed at its inner end by wall 22 from which protrudes the stub axle 24. The described structure permits friction free rotation of sleeve 20 with respect to handle 10 about a common axis.

Deformable chamber 30 is a tube which is closed at its inner end and formed of relatively soft, yieldable material such as rubber, or a rubber-like composition. The chamber is fitted glove-tightly into sleeve 20. The protruding, open end 32 of the chamber is preferably formed of more rigid rubber material and is provided with internal, annular, spaced bosses 34, separated by ring-like grooves 36 which interfit with complementary bosses and grooves on plug 40 to better seal the fluid chamber 30 against air leakage.

Figure 2:
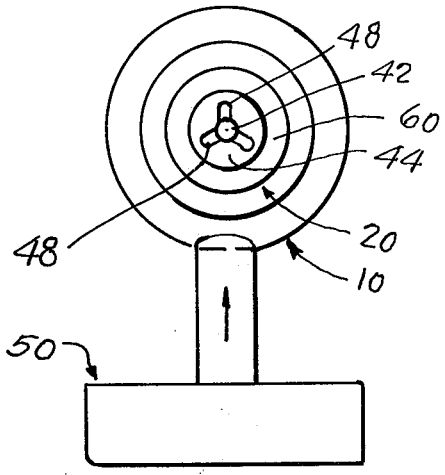
FIG. 2 is an elevational view taken from the left side of FIG. 1.

The plug 40 is also formed of a rubber, or rubber-like material, which is yieldable, but more rigid than the material of chamber 30. The plug has an axial passage 42 which communicates the interior of fluid chamber 30 with the atmosphere and connects concave end surface 44 with the convex, opposite end surface 46 of the plug, each of which surfaces serving, alternately, to hold and seat a lens. For increasing the suction areas of surfaces 44, 46, each is provided with a plurality of grooves communicating with passage 42, such as the three equiangularly spaced, radial grooves 48, best seen in FIG. 2. An outwardly extending ring boss 60 is formed centrally of plug 40 and serves as a stop against further insertion of the plug into fluid chamber 30. One or both ends of the plug are provided with alternate bosses 62 and grooves 64 which interfit with the grooves and bosses 36, 34 of fluid chamber 30, although shown at one end only in the drawing.

Figure 3:
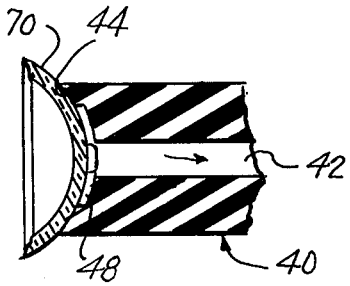
FIG. 3 is an enlarged, fragmentary, sectional view of the fluid chamber plug holding a contact lens having its convex surface seated on the plug.
Figure 5:
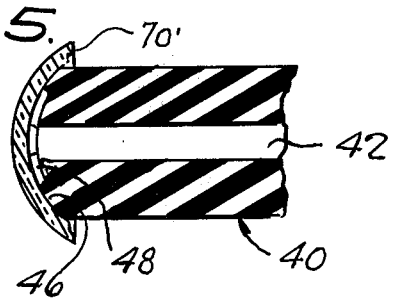
FIG. 5 is a view similar to FIG. 3, but with the plug reversed and seating the concave surface of the lens.
Figure 4:
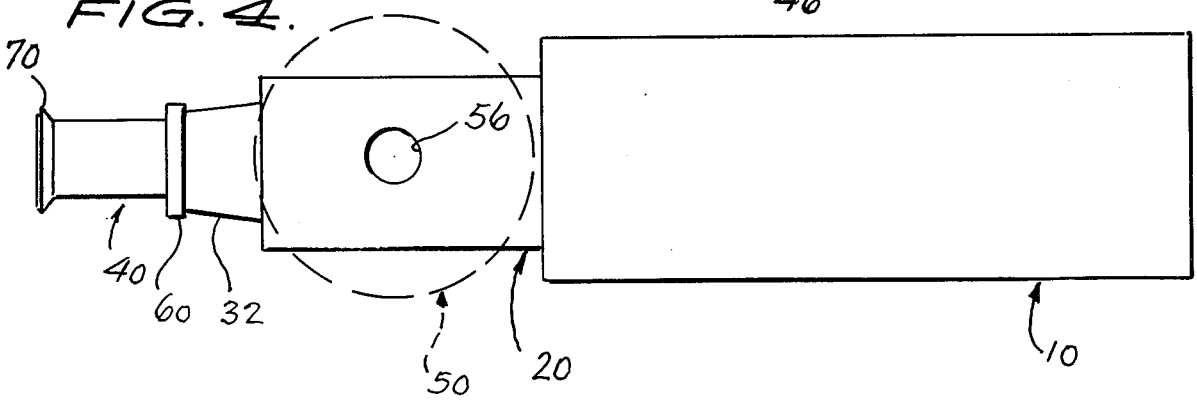
FIG. 4 is an elevational view taken from below FIG. 1, showing the evacuator in broken line.

The mechanical evacuator 50 may take many different forms, a preferred form being that of the disc handle 52 with a central, protruding stem 54, which may be inserted through opening 56 in sleeve 20 to engage and depress fluid chamber 30 to partially evacuate the same. If at this time a contact lens 70 is placed against arcuate surface 44 of plug 40, as shown in FIG. 3, atmospheric pressure will hold the lens firmly against the plug 40 due to the lesser pressure, or suction, exerted against the convex face of the lens compared to the atmospheric pressure against the concave surface of the lens. By reversing plug 40 in the mouth of chamber 30, a lens 70' may similarly have its concave face securely held against convex surface 46 of the plug, as shown in FIG. 5. By supplying additional evacuators 50 having stems 54 of different cross-sectional areas, the amount of deformation of fluid chamber 30 may be varied to change the amount of negative pressure, or suction, to accomodate lenses of different materials, shapes or weights.

The use and operation of the tool as described above is now readily apparent. The operator selects an evacuator 50 of suitable size, inserts stem 54 into opening 56 to deform chamber 30, as shown in broken lines in FIG. 1, and partially expel the air or other fluid contained therein. A lens 70 is placed against plug 40, as in FIG. 3, and the evacuator 50 is removed from opening 56 and from the instrument completely. Holding the handle 10, the operator then presses the outer face of lens 70 against a conventional rotating, spherical lap, or drum, covered with a suitable grinding or polishing abrasive. Grinding and polishing takes place in a conventional manner. The lens, along with plug 40, fluid chamber 30 and sleeve 20, spins in handle 10 but at a different rate than the drum depending upon the point at which the lens contacts the rotating drum. Differential in rotation produces friction which, abetted by the presence of polishing compound, produces the physical changes desired in the lens surface. The lens will rotate in the same or opposite direction as the drum depending upon the angle at which the lens contacts the drum. When the polishing operation is finished, the lens 70 is easily released from the instrument by again inserting the evacuator to further deform fluid chamber 30 and expel air through passage 42 and connected channels 48, thus pushing the lens away from the holding surface 44.

It is important to note that once a lens has been attached to the holder instrument, the removal of the evacuator 50 permits the sleeve 20 and the parts assembled therein to spin true and without eccentricity in handle 10, because the mechanical evacuator is no longer attached to the rotating assembly as an off-center part. In this respect, the glove-tight fit of all outer surface areas of fluid chamber 30 in sleeve 20, also enable true, non-eccentric spinning.

A further advantage of the invention is that two or more mechanical evacuators 50, having stems of different diameter, make it possible to achieve varying amounts of suction as suitable for different lenses to be worked. The provision of the plurality of suction channels 48 holds the lens more securely with less tendency to slip during rotation, or start of rotation.

Although a certain specific embodiment of the invention has been shown and described, it is obvious that many modifications thereof are possible. The invention, therefore, is not intended to be restricted to the exact showing of the drawings and description thereof but is considered to include reasonable and obvious equivalents.

What is claimed is:

1. A tool for holding a contact lens during grinding or polishing, comprising a handle, a hollow rigid receptacle open at one end and having its other end rotatably mounted in the handle, an elastomeric fluid chamer having a deformable wall and being glove-fitted into said receptacle, said fluid chamber being completely closed except for an open end protruding from said open end of the receptacle, lens seating means on the open end of said fluid chamber for supporting a lens during grinding or polishing and provided with a passage for communicating the interior of said fluid chamber with the atmosphere, and an opening through the wall of said receptacle intermediate of its ends permitting the exercise of pressure against the deformable wall of said chamber to compress the fluid chamber and partially evacuate the same, thereby enabling suction securement of a lens against said lens seating means.

2. The tool of claim 1, wherein said lens seating means comprises a plug fitted into the open end of said fluid chamber and having an exterior arcuate lens seating surface, and a passage leading from said lens seating surface through said plug and communicating with the interior of said fluid chamber.

3. The tool of claim 2, wherein said plug has lens seating surfaces of different curvature at opposite ends so that the plug may be reversed to accomodate a different lens.

4. The tool of claim 3, wherein the arcuate surface at one end of the plug is convex and the arcuate surface at the other end of the plug is concave.

5. The tool of claim 2, wherein said exterior surface of the plug is provided with a plurality of channels communicating with said passage to provide suction to a larger portion of the lens being held thereon.

6. The tool of claim 5, wherein there are three of said channels extending radially at equal angles from the outer end of said passage.

7. The tool of claim 2, wherein said plug and fluid chamber are each provided with interfitting, annular bosses and recesses for fluid sealing the connection between the plug and fluid chamber.

8. The tool of claim 1 in combination with a separate mechanical evacuator, said evacuator having a portion insertable through said receptacle opening to compress the fluid chamber and being completely removable from said opening and the tool while a lens held by the tool is being ground, thereby permitting non-eccentric spinning of the receptacle, fluid chamber, plug and vacuum secured lens with respect to the handle during grinding or polishing.

9. The tool of claim 8, wherein a plurality of evacuators are provided having operating portions of different size insertable into the receptacle opening so as to vary the area of engagement with the wall of the deformable chamber and permit variance of the resulting deformation and amount of the evacuation.

10. The tool of claim 1, wherein said other end of the hollow receptacle has a stub axle projecting therefrom which is mounted in the handle in friction-free bearings.

11. The tool of claim 1, wherein said receptacle is tubular and said opening is in its side wall.

12. The tool of claim 8, wherein said evacuator is a disc having a protruding central stem as its portion insertable in said opening of the receptacle to compress and deform the wall of the fluid chamber.

* * * * *